US007141088B2

(12) United States Patent
Nakatani et al.

(10) Patent No.: US 7,141,088 B2
(45) Date of Patent: Nov. 28, 2006

(54) EXHAUST GAS PURIFYING APPARATUS

(75) Inventors: Koichiro Nakatani, Susono (JP); Shinya Hirota, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 347 days.

(21) Appl. No.: 10/485,574

(22) PCT Filed: Aug. 7, 2000

(86) PCT No.: PCT/IB02/03115

§ 371 (c)(1),
(2), (4) Date: Feb. 3, 2004

(87) PCT Pub. No.: WO03/014538

PCT Pub. Date: Feb. 20, 2003

(65) Prior Publication Data

US 2004/0244343 A1 Dec. 9, 2004

(30) Foreign Application Priority Data

Aug. 8, 2001 (JP) ..... 2001-241350

(51) Int. Cl.
*B01D 46/00* (2006.01)

(52) U.S. Cl. ..... 55/523; 55/385.3; 55/524; 55/DIG. 10; 55/DIG. 30; 60/311

(58) Field of Classification Search ..... 55/282.2, 55/282.3, 385.3, 523, 524, 525, 527, DIG. 10, 55/DIG. 30; 60/311; 428/116, 117, 118
See application file for complete search history.

(56) References Cited

U.S. PATENT DOCUMENTS 4,519,820 A * 5/1985 Oyobe et al. ..... 55/523
4,695,301 A 9/1987 Okajima et al.
4,732,593 A 3/1988 Kondo et al.
6,656,564 B1 * 12/2003 Ichikawa et al. ..... 55/523
6,712,884 B1 * 3/2004 Bruck et al. ..... 55/282.3
6,827,754 B1 * 12/2004 Suwabe et al. ..... 55/523
6,991,668 B1 * 1/2006 Towsley ..... 55/523

FOREIGN PATENT DOCUMENTS

| | | | |
|---|---|---|---|
| EP | 0 225 402 A1 | | 6/1987 |
| EP | 0 745 759 A2 | * | 12/1996 |
| EP | 1 270 884 A1 | | 1/2003 |
| JP | 64-12614 | | 1/1964 |
| JP | 10-317944 A | * | 12/1998 |
| JP | A-10-317944 | | 12/1998 |
| WO | WO 94/22556 | | 10/1994 |

* cited by examiner

*Primary Examiner*—Jason M. Greene
(74) *Attorney, Agent, or Firm*—Oliff & Berridge, PLC

(57) ABSTRACT

A particulate filter (22) for collecting particulates in the exhaust gas is comprised. The particulate filter (22) includes partitioning walls (54) for forming passages (50, 51). The partitioning walls (54) are made of a porous material. The end portions of adjacent partitioning walls (54) are brought close each other so as to narrow the respective passage formed by the partitioning walls (54), and the cross-sectional area of the flow path at the end region of the passage is made to be smaller than the cross-sectional area of the flow path in the remaining regions of the passage. The particulate filter (22) has an extended portion (55) which extends beyond the top ends of the partitioning walls (54) from the end surface of the particulate filter (22).

23 Claims, 9 Drawing Sheets

EXHAUST GAS PURIFYING APPARATUS

BACKGROUND OF THE INVENTION

1. Field of the Invention

The invention relates to an exhaust gas purifying apparatus in the following: exhaust gas purifying apparatus, and particularly to a structure of a particulate filter as a component of an exhaust gas-purifying apparatus.

2. Description of the Related Art

A particulate filter for collecting particulates in the exhaust gas discharged from an internal combustion engine is disclosed in published Japanese translation of PCT-application, JP-T-8-508199. In this particulate filter, a honeycomb structural body is made of a porous material. Among a plurality of passages in this honeycomb structural body (hereinafter referred to as filter passages), some of the filter passages are closed with plugs at their upstream ends whereas the remaining filter passages are closed with plugs at their downstream ends, so that the exhaust gas flowed into the particulate filter always passes the walls which forms the filter passages (hereinafter referred to as filter partitioning walls) without fail and then flows out of the particulate filter.

ID this particulate filter, since the exhaust gas always passes the filter partitioning walls without fail and then flows out of the particulate filter, its particulate collection rate is higher than the particulate collection rate of a particulate filter in which the exhaust gas only passes the filter passages without passing the partitioning walls of the particulate filter.

In the particulate filter described in the aforementioned Patent Publication, the filter passages are closed by combining the end portions of the filter partitioning walls together and then by connecting these end portions with each other. As a result of this structure, the exhaust gas inlet openings of the filter passages are shaped into the form of a funnel. According to the structure wherein the exhaust gas inlet openings of the filter passages are shaped into the form of a funnel as in the manner described above, the exhaust gas smoothly flows into the filter passages without causing turbulence. In other words, when the exhaust gas flows into the filter passages, the exhaust gas never turns into turbulence. For this reason, the pressure loss in the particulate filter described in this Patent Publication is low.

Meanwhile, in the particulate filter described above, the top ends of the combined partitioning walls are sharply pointed. Therefore, for example, when the particulate filter is handled in order to install the particulate filter in the exhaust passage of the internal combustion engine, if these combined partitioning walls are brought into contact with the parts and the like of the internal combustion engine, the top ends of the combined partitioning walls become chipped.

SUMMARY OF THE INVENTION

An object of the invention is to provide a structure capable of preventing the top ends of the partitioning walls brought close to each other and in a particulate filter from being damaged when the particulate filter is being handled.

An exhaust purifying apparatus according to a first aspect of the invention is provided with a particulate filter for collecting particulates in exhaust gas, and the particulate filter includes partitioning walls for forming a passage. The partitioning walls are made of a porous material, and end portions of the partitioning walls are combined together such that the cross-sectional area of a flow path formed by the end portions of the partitioning walls is smaller than that of a flow path formed by the remaining portion of the partitioning walls. In addition, the particulate filter has an extended portion which extends beyond the top ends of the partitioning walls from the end surface of the particulate filter. The extended portion can be provided at various locations, e.g. at the outer peripheral walls but also at selected partitioning walls. According the first aspect wherein the extended portion which extends beyond the top ends of the partitioning walls from the end surface of the particulate filter is provided in the particulate filter according to the first aspect of the invention, the top ends of the partitioning walls combined together are not damaged when the particulate filter is being handled.

In addition, in the aforementioned first aspect, the extended portion may be a portion of an outer peripheral wall of the particulate filter which extends beyond the top ends of the partitioning walls.

Further, a portion of the outer peripheral wall which extends beyond the top ends of the partitioning walls may be structured so as to extend in such a manner that they surround the top ends of the partitioning walls.

Further, a portion of the outer peripheral wall which extends beyond the top ends of the partitioning walls may have an increased rigidity by, for example, increasing their thickness.

In the aforementioned first aspect, an oxidizing substance capable of oxidizing particulates may be supported on the partitioning walls.

In the aforementioned first aspect, the end portions of the partitioning walls may be combined together, and the top ends of the partitioning walls may be connected to each other so as to close an end surface of the passage.

BRIEF DESCRIPTION OF THE DRAWINGS

The foregoing and further aspects, features and advantages of the invention will become apparent from the following description of preferred embodiments with reference to the accompanying drawings.

DETAILED DESCRIPTION OF EXEMPLARY EMBODIMENTS

Figure 1A:
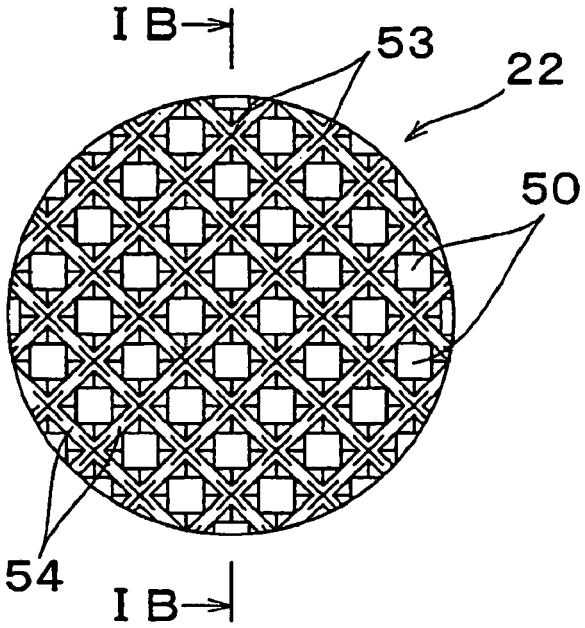
FIGS. 1A and 1B are diagrams showing a particulate filter of the invention.
Figure 1B:
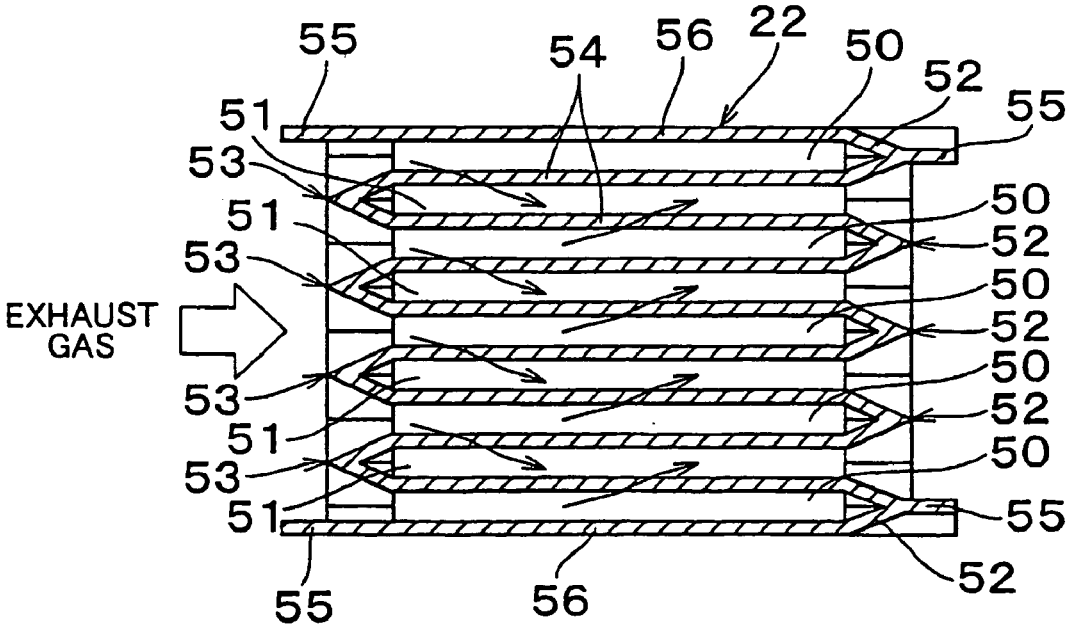

Hereinafter, embodiments of the invention will be described with reference to drawings. FIG. 1A is an end elevation of a particulate filter, and FIG. 1B is a diagram showing a cross-section along the line IB–IB of the particulate filter of FIG. 1A. As is shown in FIGS. 1A and 1B, a particulate filter 22 has a honeycomb structure, and comprises a plurality of exhaust flow passages 50, 51 extending in parallel to each other. These exhaust flow passages are structured by exhaust gas inlet passages 50 each having a downstream end closed with a tapered wall (hereinafter referred to as a downstream tapered wall) 52, and exhaust gas outlet passages 51 each having an upstream end closed with a tapered wall (hereinafter referred to as an upstream tapered wall) 53. That is, the exhaust flow passages 50 which are some of the exhaust flow passages are closed with the downstream tapered walls 52 at their downstream ends, whereas the remaining exhaust flow passages 51 are closed with the upstream tapered walls 53 at their upstream end.

Although details will be described later, the downstream tapered wall 52 is formed by combining downstream end partitioning wall portions of the partitioning walls which form the exhaust gas inlet passage 50 of the particulate filter 22 and connecting them with each other. On the other hand, the upstream tapered wall 53 is formed by combining upstream end partitioning wall portions of the partitioning walls which form the exhaust gas outlet passage 51 of the particulate filter 22 and connecting them with each other.

In this embodiment, the exhaust gas inlet passages 50 and exhaust gas outlet passages 51 are alternately disposed via a thin partitioning wall 54. In other words, the exhaust gas inlet passages 50 and the exhaust gas outlet passages 51 are disposed in such a manner that each exhaust gas inlet passage 50 is enclosed with four exhaust gas outlet passages 51 and each exhaust gas outlet passage 51 is enclosed with four exhaust gas inlet passages 50. That is, one exhaust flow passage 50 among two adjacent exhaust flow passages is completely closed with the downstream tapered wall 52 at its downstream end, whereas the other exhaust flow passage 51 is completely closed with the upstream tapered wall 53 at its upstream end.

The particulate filter 22 is made of a porous material such as cordierite. Therefore, the exhaust gas flowed into exhaust gas inlet passage 50 passes through the surrounding partitioning walls 54 as shown by an arrow in FIG. 1B, and then flows into the adjacent exhaust gas outlet passage 51. It is a matter of course that, since the tapered walls 52, 53 are made of the material of the same type as that of the partitioning walls 54, the exhaust gas can flow through the upstream tapered wall 53 as shown by an arrow in FIG. 2A and then flows into the exhaust gas outlet passage 51, and in addition, can flow out through the downstream tapered wall 52 as shown by an arrow in FIG. 2B.

Meanwhile, the upstream tapered wall 53 is shaped into the form of square cone which is narrowed toward the upstream side in such a manner that the cross-sectional area of the flow path of the exhaust gas outlet passage 51 is gradually decreased. Therefore, the upstream end of the exhaust gas inlet passage 50 which is formed by being enclosed with four upstream tapered walls 53 is shaped into the form of square cone which widens toward the upstream side in such a manner that the cross-sectional area of the flow path of the exhaust gas inlet passage 50 is gradually increased. According to this structure, the exhaust gas flows into the particulate filter more easily as compared with the case where the inlet opening of the exhaust gas inlet passage is structured as shown in FIG. 3A.

Figure 3A:
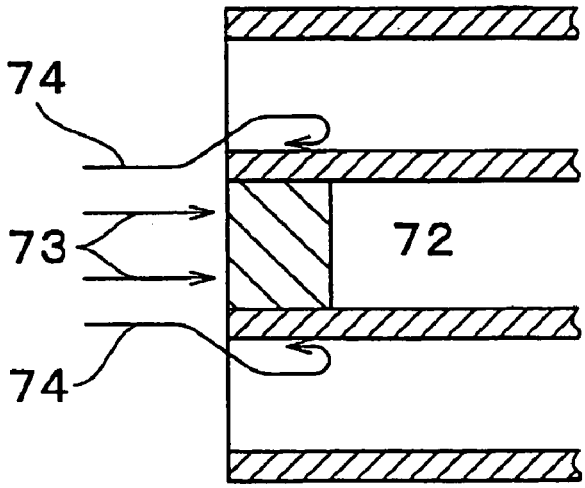
FIG. 3A RELATED ART
FIGS. 3A and 3B are diagrams showing a particulate filter which is a related art of the invention.

That is, in the particulate filter shown in FIG. 3A, the upstream end of the exhaust gas outlet passage is closed with a plug 72. In this case, since a part of the exhaust gas collides with the plug 72 as is indicated by the reference numeral 73, it is difficult for the exhaust gas to flow into the exhaust gas inlet passage. For this reason, the pressure loss of the particulate filter becomes large. In addition, the exhaust gas flowing from the vicinity of the plug 72 into the exhaust gas inlet passage turns into turbulence in the vicinity of the inlet as shown by the reference numeral 74. This also makes it difficult for the exhaust gas to flow into the exhaust gas inlet passage. As a result, the pressure loss of the particulate filter becomes far larger.

Figure 2A:
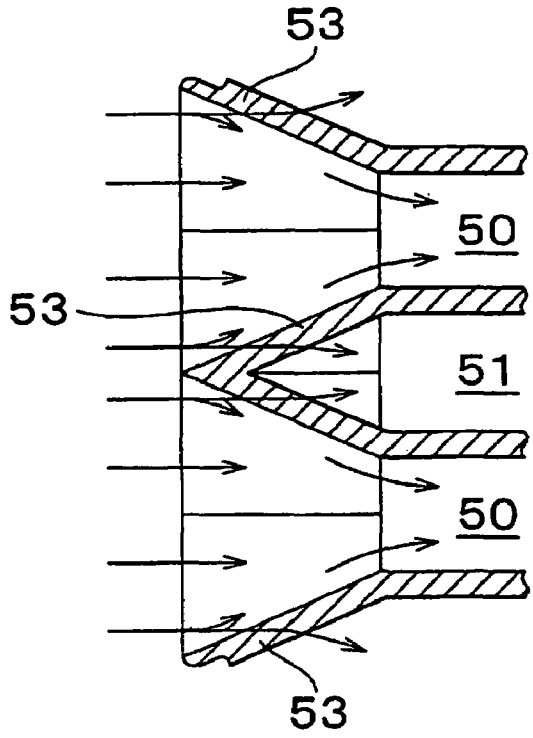
FIGS. 2A and 2B are diagrams showing a part of the particulate filter of the invention.

On the other hand, in the particulate filter 22 of the invention, as shown in FIG. 2A, the exhaust gas can flow into the exhaust gas inlet passage 50 without turning into turbulence. Due to this structure, according to the invention, the exhaust gas easily flows into the particulate filter 22. Therefore, the pressure loss of the particulate filter 22 is low.

Further, in the particulate filter shown in FIG. 3, a large amount of the particulates in the exhaust gas tends to accumulate on the upstream end surface of the plug 72 and on the surface of the partitioning walls in the vicinity thereof. This is because the exhaust gas collides with the plug 72, and in addition, the exhaust gas turns into turbulence in the vicinity of the plug 72. Contrarily, in the particulate filter 22 of the invention, since the upstream tapered wall 53 is in the shape of square cone, there exists no upstream end surface with which the exhaust gas strongly collides, and in addition, the exhaust gas does not turn into turbulence in the vicinity of the upstream end surface. Therefore, according to the invention, a large amount of particulates does not accumulate in the upstream end region of the particulate filter 22, resulting in suppressing the increase in pressure loss of the particulate filter 22.

On the other hand, the downstream tapered wall 52 is shaped into the form of square cone which is narrowed toward the downstream side in such a manner that the cross-sectional area of the flow path of the exhaust gas inlet passage 50 is gradually decreased. Therefore, the downstream end of the exhaust gas outlet passage 51 which is formed by being enclosed with four downstream tapered walls 52 is shaped into the form of square cone which widens toward the downstream side in such a manner that the cross-sectional area of the flow path of the exhaust gas outlet passage 51 is gradually increased. According to this structure, the exhaust gas flows from the particulate filter more easily as compared with the case where the outlet opening of the exhaust gas outlet passage is structured as shown in FIG. 3B.

Figure 3B:
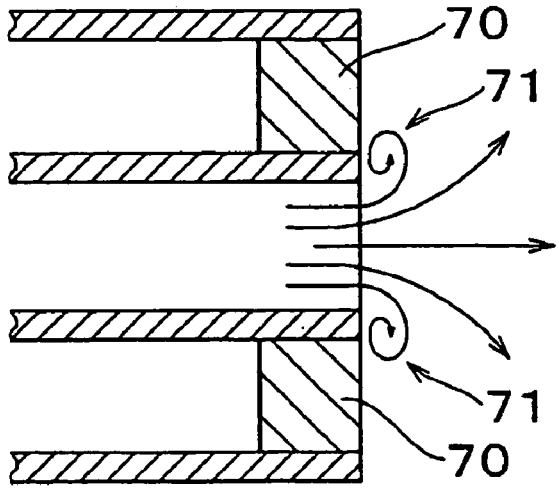
FIG. 3B RELATED ART

That is, in the particulate filter shown in FIG. 3B, the downstream end of the exhaust gas inlet passage is closed with a plug 70, and the exhaust gas outlet passage extends straight up to its outlet opening. In this case, a part of the exhaust gas which has come out of the outlet opening of the exhaust gas outlet passage flows along the downstream end surface of the plug 70, and as a result of this, turbulence 71 is produced in the vicinity of the outlet opening of the exhaust gas outlet passage. If the turbulence is produced as described above, it is difficult for the exhaust gas to flow out of the exhaust gas outlet passage.

Figure 2B:
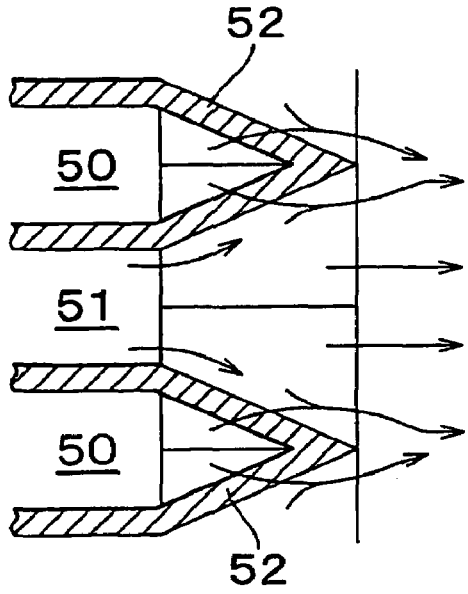

On the other hand, in the particulate filter of the invention, as shown in FIG. 2B, the exhaust can flow out through the outlet opening at the end portion of the exhaust gas outlet passage 51 without turning into turbulence. Therefore, according to the invention, the exhaust gas flows out of the particulate filter relatively easily. Accordingly, due to this structure as well, the value of the pressure loss of the particulate filter 22 is made low.

The tapered walls 52, 53 may be in any other shapes than the square cone, for example, a round cone, as long as they are shaped so as to be gradually narrowed toward the outside of the particulate filter 22.

By the way, since the tapered walls 52, 53 are shaped into square cones as described above, their top ends are sharply pointed. In this structure, the top ends are likely to be broken when they are in contact with some other objects while the particulate filter 22 is being handled, for example, in order to install the particulate filter 22 in an internal combustion engine.

Therefore, in the particulate filter 22 of the invention, its outer peripheral walls 56 are shaped so as to extend beyond the end surface formed by the top ends of the tapered walls 52, 53 in the axial direction of the particulate filter 22, i.e. the flow direction of the exhaust gas within the particulate filter. In other words, the particulate filter 22 of the invention comprises portions of the outer peripheral wall 56 (hereinafter referred to as extended portions) 55 extending beyond the end surface formed by the top ends of the tapered walls 52, 53, that is, beyond the end surface of the particulate filter 22. The extended portions 55 of the outer peripheral walls 56 extend so as to surround the top ends of the tapered walls 52, 53.

According to this structure, it is the extended portions 55 of the outer peripheral walls 56 that come into contact with some other objects when the particulate filter 22 is being handled. Thus, the top ends of the tapered walls 52, 53 are never brought into contact with any objects, and therefore, the top ends of the tapered walls 52, 53 are prevented from being damaged.

Further, the particulate filter 22 of the invention is structured in such a manner that the rigidity is high at least at the extended portions 55 of the outer peripheral walls 56. In this embodiment, for example, the rigidity is increased by making the thickness of the extended portions 55, preferably that of the outer peripheral walls 56 as a whole, larger than the thickness of the partitioning walls 54. Due to this arrangement, even if the portions 55 of the outer peripheral walls 56 extending beyond the end surface of the particulate filter 22 come into contact with some other objects when the particulate filter 22 is being handled, the portions 55 of the outer peripheral walls are prevented form being damaged. Further, in the invention, a part of the outer peripheral wall is used as a means for preventing the top ends of the tapered walls 52, 53 from being damaged. Therefore, the damage preventing means can be easily produced as compared with the case where such a damage preventing means is additionally mounted to the particulate filter, and in addition, its structure is simple.

In this embodiment, the portions 55 of the outer peripheral walls 56 extending beyond the end surface of the particulate filter 22 extend over the entire periphery of the particulate filter 22. However, the object of the invention can also be achieved if some of the respective outer peripheral walls 56 of the particulate filter 22 extends beyond the end surface of the particulate filter 22. Furthermore, in order to achieve the object of the invention, it is sufficient that the particulate filter at least has a portion extending beyond its end surface.

Meanwhile, it is important for the particulate filter 22, in terms of its performance, to be structured in such a manner that the pressure loss is potentially lowered and the pressure loss does not deviate from a potentially achievable value when the particulate filter 22 is being used.

In other words, when an internal combustion engine comprises a particulate filter for example, the operation control of the internal combustion engine is designed taking into consideration the potential pressure loss of the particulate filter. For this reason, even if the particulate filter is structured so that its pressure loss becomes low, when the pressure loss deviates from the potentially achievable value when the particulate filter is being used, the performance of the internal combustion engine as a whole is lowered.

Therefore, according to the invention, as has been described above, the partitioning walls which form the upstream end region of the exhaust flow passage in the particulate filter 22 are made into tapered wall. This structure prevents the exhaust gas from turning into turbulence when it flows into the exhaust flow passage, thereby potentially lowering the pressure loss of the particulate filter 22.

Further, as has been described above, the partitioning walls which form the upstream end region of the exhaust flow passage in the particulate filter 22 are made into the tapered walls, and this makes it difficult for particulates to be accumulated on the wall surfaces of the tapered walls. In other words, this prevents the exhaust gas flowing into the exhaust flow passage from turning into turbulence which is caused by accumulation of particulates on the wall surfaces of the tapered walls during the use of the particulate filter 22. Due to this arrangement, according to the invention during the use of the particulate filter, deviation of the pressure loss from a potentially achievable value which would result in high pressure loss is suppressed.

By the way, as has been described above, particulates do not easily accumulate on the upstream tapered walls 53 when the particulate filter 22 is being used. However, there are some cases where particulates may possibly be accumulated on the upstream tapered walls 53. In such cases, the pressure loss of the particulate filter 22 becomes high when it is being used.

Therefore, in the invention, an oxidizing substance capable of oxidizing and removing the particulates are supported on the upstream tapered walls 53, so that the particulates accumulated on the upstream tapered walls 53 are oxidized and removed. According to this arrangement, since the particulates collected by the upstream tapered walls 53 are continuously oxidized and removed, a large amount of particulates is never accumulated on the upstream tapered walls 53. Therefore, the pressure loss of the particulate filter 22 is kept at low value even when it is being used.

As described above, according to the invention, a specific problem arising from the structure where the exhaust gas outlet passages 51 are closed with the upstream tapered walls 53 made of a porous material in order to potentially lower the pressure loss of the particulate filter 22, that is, a problem that the pressure loss of the particulate filter deviates from the achievable value when it is being used, can be avoided.

In this embodiment, the oxidizing substance is supported on the particulate filter 22 as a whole, that is, not only on the upstream tapered walls 53 but also the partitioning walls 54 and the downstream tapered walls 52. Furthermore, the oxidizing substance is supported not only on the wall surfaces of the upstream tapered walls 53, the downstream tapered walls 52, and the partitioning walls 54, respectively, but also on the microporous walls inside them. In addition, in this embodiment, the amount of the oxidizing substance to be supported on the upstream tapered walls 53 per unit volume is made larger than the amount of the oxidizing substance to be supported on the partitioning walls 54 and the downstream tapered walls 52 per unit volume.

Figure 4A:
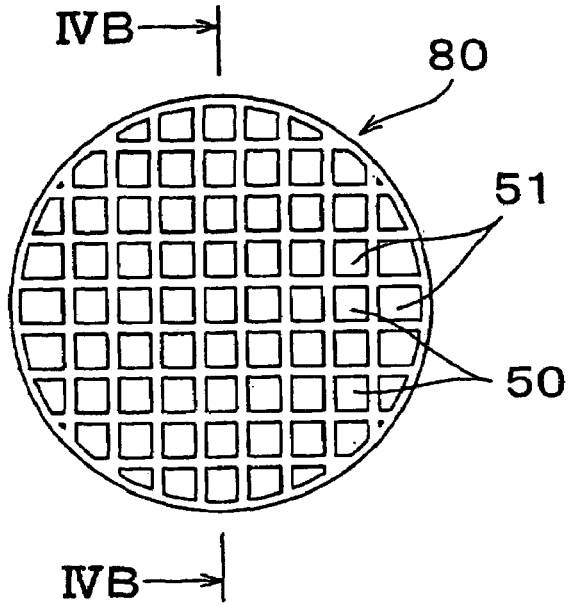
FIGS. 4A and 4B are diagrams showing a honeycomb structural body.
Figure 4B:
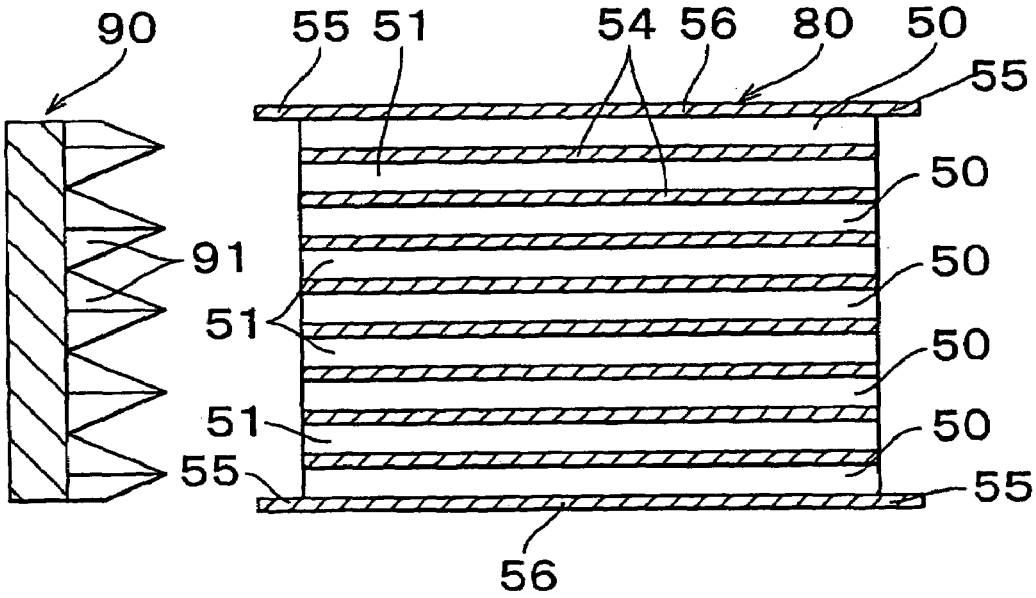

Next, a method for manufacturing the particulate filter will be briefly described. FIG. 4A shows a cylindrical-shaped honeycomb structural body, and FIG. 4B shows a cross-section of the honeycomb structure body along the line IVB—IVB. First, a cylindrical-shaped honeycomb structural body 80 such as shown in FIG. 4 is extruded from a porous material such as cordierite and the like. The honeycomb structural body 80 has a plurality of exhaust flow passages each having a square-shaped cross-section. Some of these exhaust flow passages are used as exhaust gas inlet passages 50 of the particulate filter 22, whereas the remaining exhaust flow passages are used as exhaust gas outlet passages 51 of the particulate filter 22. In addition, the outer peripheral walls of the honeycomb structural body 80 extend beyond the end surface of the honeycomb structural body 80 at its both ends, so as to provide extended portions 55.

Figure 5A:
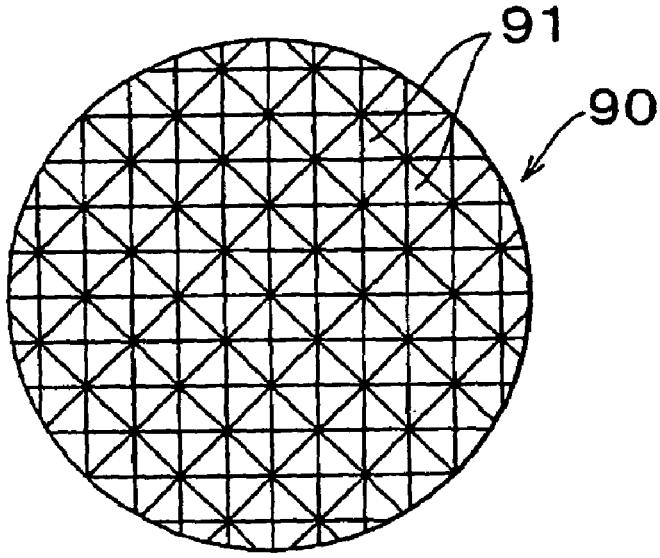
FIGS. 5A and 5B are diagrams showing a mold.

Next, a mold 90 shown in FIG. 5 is pressed against the end surface of the honeycomb structural body 80. As shown in FIG. 5A, the mold 90 has a plurality of projections 91 each having the shape of square cone.

Figure 5B:
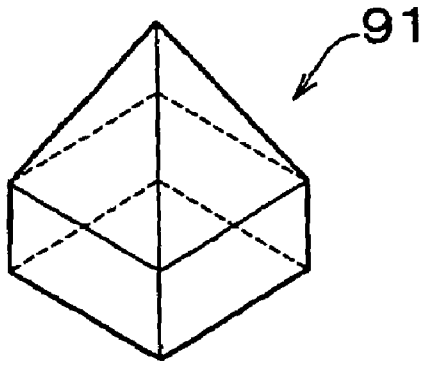

FIG. 5B shows one projection 91. The mold 90 is pressed against each end surface of the honeycomb structural body 80 in such a manner that the projections 91 are inserted into the predetermined exhaust flow passages, respectively. At this time, the partitioning walls which form the predetermined exhaust flow passages, that is, the partitioning walls 54 are combined together so as to form tapered walls. The predetermined exhaust flow passages are completely closed with the tapered walls.

Then, the honeycomb structural body is dried. Subsequently, the honeycomb structural body is baked. After that, an oxidizing substance is supported on the honeycomb structural body. As a result of these steps, a particulate filter is formed.

As described above, the particulate filter 22 is closed at its end portions with the tapered walls 52, 53 made of the same type of porous material as of the partitioning walls 54 of the particulate filter 22. Therefore, in an extremely simple method such as described above where the mold 90 is pressed against the end surfaces of the honeycomb structural body, the exhaust flow passages 50, 51 of the particulate filter 22 can be closed with the same material as of the partitioning walls 54.

Herein, the step of pressing the mold 90 against the end surfaces of the honeycomb structural body 80 may be performed after the honeycomb structural body is dried. Alternatively, after the honeycomb structural body 80 is baked, the end portions of the honeycomb structural body 80 may be softened, and then, the mold 90 may be pressed against the softened end portions. Thereafter, in this case, the end portions of the honeycomb structural body 80 are baked again.

Figure 6:
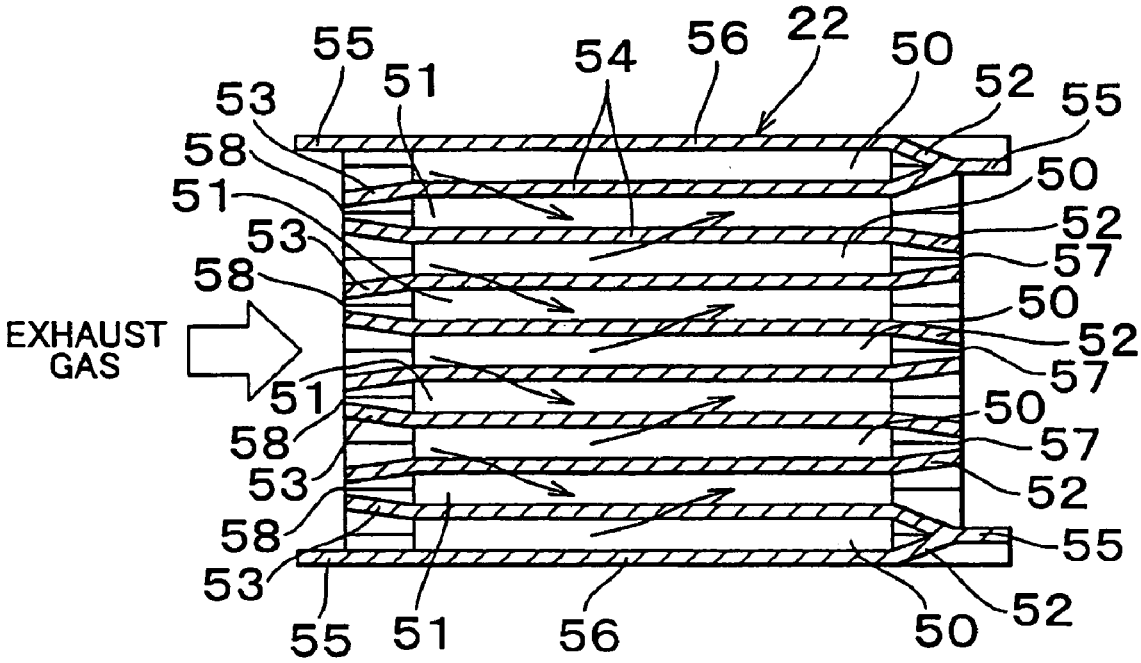
FIG. 6 is a diagram showing a particulate filter according to another embodiment of the invention.

In the above embodiment, description has been given of the case where the invention is applied to the particulate filter in which the top ends of the tapered walls 52, 53 are completely closed. However, the invention is also applicable to a particulate filter in which the top ends of some of the tapered walls 52, 53 are provided with small holes 57, 58 as shown in FIG. 6 for example, so as to obtain the same effect as that obtained in the embodiment described above. Specifically, the invention is applicable to any particulate filters as long as they comprise the tapered walls at the end portions of the exhaust flow passages in such manner that the cross-sectional area of the flow path of the respective exhaust flow passages is gradually decreased toward the end portions, thereby obtaining the same effect which has been described in relation to the aforementioned embodiment. Herein, the size of the respective holes 57, 58 is larger than the diameter of each micropore of the porous material which constitutes the tapered walls 52, 53.

Next, oxidizing substance supported on the particulate filter 22 will be described in detail. In this embodiment, a carrier layer made of alumina for example is entirely formed over the peripheral wall surfaces of the respective exhaust gas inlet passages 50 and the respective exhaust gas outlet passages 51, that is, both side surfaces of the respective partitioning walls 54 and the both side surfaces of the tapered walls 52, 53. On this carrier, supported are a noble metal catalyst and an active oxygen releasing agent that captures and hold oxygen when excessive oxygen exists in the surroundings and releases the oxygen which it holds into the form of active oxygen when the concentration of oxygen in the surroundings is lowered. The oxidizing substance of this embodiment is the active oxygen releasing agent.

In this embodiment, platinum Pt is used as the noble metal catalyst. As the active oxygen releasing agent, used is at least one selected from alkaline metals such as potassium K, sodium Na, lithium Li, cesium Cs, rubidium Rb, and the like; alkaline earth metals such as barium Ba, calcium Ca, strontium SF and the like; rare-earth elements such as lanthanum La, yttrium Y, cerium Ce and the like; transition metals such as iron Fe; and carbon group elements such as tin Sh.

As the active oxygen releasing agent, it is preferable to use alkaline metals or alkaline earth metals which has a higher ionization tendency as compared to calcium Ca, that is, potassium K, lithium Li, cesium Cs, rubidium Rb, barium Ba, and strontium Sr.

Next, an action of removing particulates in the exhaust gas by the particulate filter 22 will be described, taking a case where platinum Pt and potassium K are supported on the carrier as an example. However, the same particulate removing action may be achieved even when other noble metals, alkaline metals, alkaline earth metals, rare-earth elements, or transition metals are used.

For example, description will be given on the assumption that the exhaust gas flowing into the particulate filter 22 is a gas released from a compression ignition-type internal combustion engine in which fuel is burned under the excessive air condition. On this assumption, the exhaust gas flowing into the particulate filter 22 contains a large amount of excessive air. Specifically, defining the ratio between the air and the fuel supplied to an intake passage and a combustion chamber 5 as an air fuel ratio of the exhaust gas, the air fuel ratio of the exhaust gas is lean in the compression ignition-type internal combustion engine. In addition, since nitric oxide NO is generated in the combustion chamber of the compression ignition-type internal combustion engine, nitric oxide NO is contained in the exhaust gas. Further, the fuel contains a sulfur component S, and the sulfur component S reacts with oxygen to produce sulfur dioxide $SO_2$ in the combustion chamber. Therefore, the exhaust gas contains sulfur dioxide $SO_2$. For this reason, the exhaust gas containing excessive oxygen, nitric oxide NO, and sulfur dioxide $SO_2$ comes to flow into the exhaust gas inlet passages 50 of the particulate filter 22.

Figure 7A:
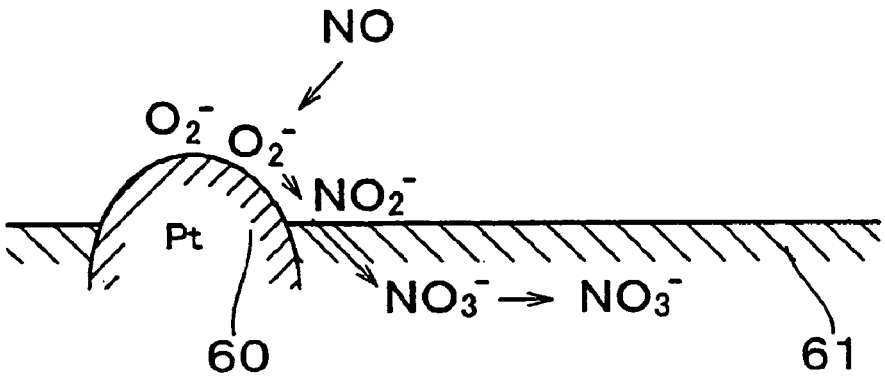
FIGS. 7A and 7B are diagrams for illustrating the action of oxidizing particulates.
Figure 7B:
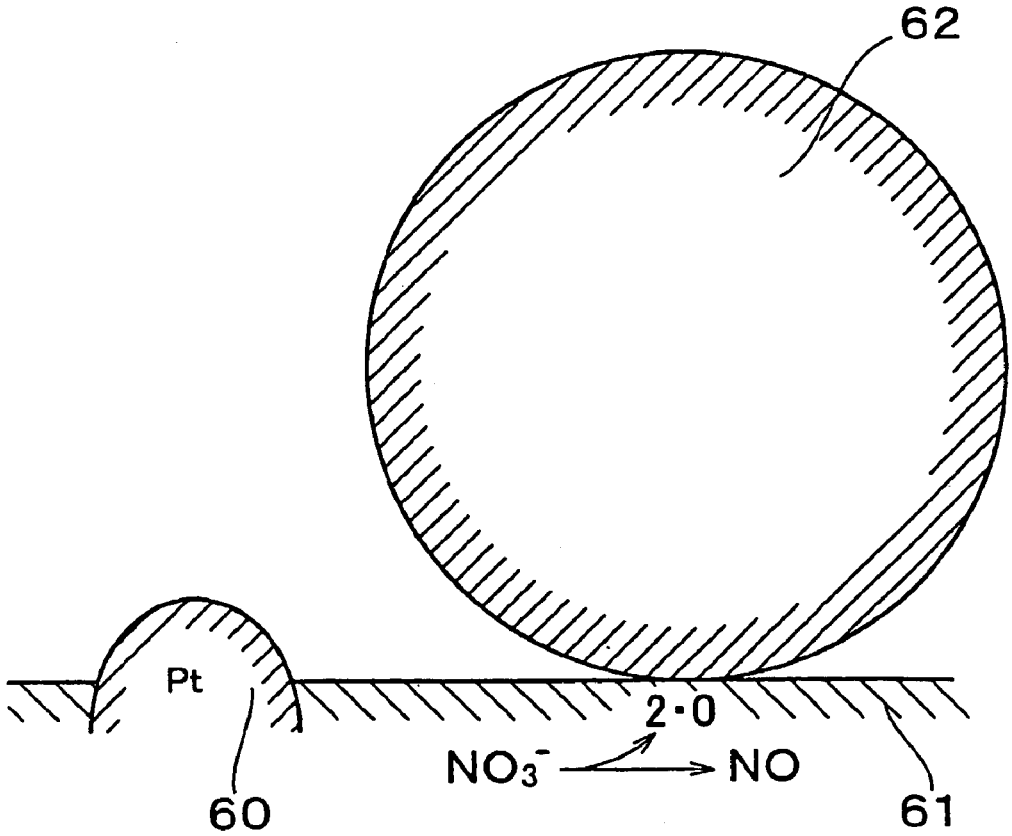

FIGS. 7A and 7B schematically shows enlarged diagrams of the surface of the carrier layer formed on the inner peripheral surface of the respective exhaust gas inlet passages 50. In FIGS. 7A and 7B, the reference numeral 60 denotes particles of platinum Pt, and 61 denotes an active oxygen releasing agent containing potassium K.

The exhaust gas contains a large amount of excessive oxygen as described above. Therefore, when the exhaust gas flows into the exhaust gas inlet passages 50 of the particulate filter 22, the oxygen $O_2$ adheres to the surface of the platinum Pt in the form of $O_2^-$ or $O^{2-}$, as shown in FIG. 7A. On the other hand, nitric oxide NO in the exhaust gas reacts with $O_2^-$ or $O_2^-$ on the surface of the platinum Pt so as to produce nitrogen dioxide $NO_2$ ($2NO+O_2 \rightarrow 2NO_2$). Then, a part of the nitrogen dioxide $NO_2$ thus produced is occluded by the active oxygen releasing agent 61 while being oxidized on the platinum Pt, and disperses into the active oxygen releasing agent 61 in the form of nitrate ion $NO_3^-$ as shown in FIG. 7A while bonding with potassium K so as to produce potassium nitrate $KNO_3$.

On the other hand, the exhaust gas also contains sulfur dioxide $SO_2$ as described above. This sulfur dioxide $SO_2$ is also occluded by the active oxygen releasing agent 61 by the same mechanism as that for occluding nitric oxide NO. Specifically, oxygen $O_2$ adheres to the surface of platinum Pt in the form of $O_2^-$ or $O^{2-}$ as described above, and the sulfur dioxide $SO_2$ in the exhaust gas-reacts with $O_2^-$ or $O^{2-}$ on the surface of platinum Pt so as to produce sulfur trioxide $SO_3$. Then, a part of the sulfur trioxide $SO_3$ thus produced is occluded by the active oxygen releasing agent 61 while being further oxidized on the platinum Pt surface, and disperses into the active oxygen releasing agent 61 in the form of sulfate ion $SO_4^{2-}$ while bonding with potassium K so as to produce potassium sulfate $K_2SO_4$. In this manner, potassium nitrate $KNO_3$ and potassium sulfate $K_2SO_4$ are produced in the active oxygen releasing agent 61.

On the other hand, particulates mainly composed of carbon C are produced in the combustion chamber 5. Therefore, the exhaust gas contains these particulates. These particulates, as shown by the reference numeral 62 in FIG. 7B, contained in the exhaust gas come into contact with and adhere to the surface of the carrier layer, for example, the surface of the active oxygen releasing agent 61, when the exhaust gas is flowing through the exhaust gas inlet passages 50 of the particulate filter 22, or when the exhaust gas flows from the exhaust gas inlet passages 50 to the exhaust gas outlet passages 51.

When the particulates 62 adhere to the surface of the active oxygen releasing agent 61 as described above, the oxygen concentration is lowered at the contact surface between the particulates 62 and the active oxygen releasing agent 61. When the oxygen concentration is lowered, a concentration difference is created between the contact surface and the inside of the active oxygen releasing agent 61 which has high oxygen concentration. Thus, oxygen in the active oxygen releasing agent 61 tries to move toward the contact surface between the particulates 62 and the active oxygen releasing agent 61. As a result, potassium nitrate $KNO_3$ formed in the active oxygen releasing agent 61 is decomposed into potassium K, oxygen O and nitric oxide NO, and oxygen O moves toward the contact surface between the particulates 62 and the active oxygen releasing agent 61 whereas nitric oxide NO is released outside from the active oxygen releasing agent 61. The nitric oxide NO which has been released outside is oxidized on platinum Pt at the downstream side, and then is occluded again by the active oxygen releasing agent 61.

Further, at this time, potassium sulfate $K_2SO_4$ formed in the active oxygen releasing agent 61 is also decomposed into potassium K, oxygen O and sulfur dioxide $SO_2$, and oxygen O moves toward the contact surface between the particulates 62 and the active oxygen releasing agent 61 whereas sulfur dioxide $SO_2$ is released outside from the active oxygen releasing agent 61. The sulfur dioxide $SO_2$ which has been released outside is oxidized on platinum Pt at the downstream side, and then is occluded again by the active oxygen releasing agent 61. However, since potassium sulfate $K_2SO_4$ is stable and can not easily be decomposed, it is difficult for potassium sulfate $K_2SO_4$ to release active oxygen as compared with potassium nitrate $KNO_3$.

As described above, when the active oxygen releasing agent 61 occludes NOx in the form of nitrate ion $NO_3^-$, it also produces and releases active oxygen in the reaction process with oxygen. Similarly, as described above, when the active oxygen releasing agent 61 occludes sulfur dioxide $SO_2$ in the form of sulfate ions $So_4^{2-}$, it also produces and releases active oxygen in the reaction process with oxygen.

Meanwhile, the oxygen O which moves toward the contact surface between the particulates 62 and the active oxygen releasing agent 61 is oxygen decomposed from the compounds such as potassium nitrate $KNO_3$ and potassium sulfate $K_2SO_4$. The oxygen decomposed from compounds has high energy, and has extremely highly activated state. Therefore, the oxygen which moves toward the contact surface between the particulates 62 and the active oxygen releasing agent 61 is in the state of active oxygen O. Similarly, the oxygen produced in the reaction process between NOx and oxygen in the active oxygen releasing agent 61, or in the reaction process between sulfur dioxide $SO_2$ and oxygen is also in the state of active oxygen. When the active oxygen O comes into contact with the particulates 62, the particulates 62 are oxidized in a short time (from several seconds to several tens of minutes) without producing a bright flame, and the particulates 62 completely disappear. Therefore, the particulates 62 hardly accumulate on the particulate filter 22.

As is the conventional cases, when the particulates accumulated into the multilayered state on the particulate filter 22 are burned, the particulate filter 22 is brought to a red heat and the particulates are burned with flames. Such a burning accompanied with flames can be continued only at a high temperature. Therefore, in order to continue the burning accompanied with flames such as described above, the particulate filter 22 must be held at high temperature.

Contrarily to the above, in the invention, the particulates 62 are oxidized without producing a bright flame as described above, and at this time, the particulate filter 22 is not brought to a red heat at its surface. In other words, in the invention, the particulates 62 are oxidized and removed at considerably lower temperature as compared with conventional cases. Therefore, the action of removing particulates by oxidizing the particulates 62 without producing a bright flames according to the invention is completely different from the conventional particulates removing action accompanied with flames.

Meanwhile, platinum Pt and the active oxygen releasing agent 61 are activated as the temperature of the particulate filter 22 rises. Therefore, the amount of the oxidizable and removable particulates which can be oxidized and removed per unit time on the particulate filter 22 without producing a bright flame increases as the temperature of the particulate filter 22 rises.

Figure 9:
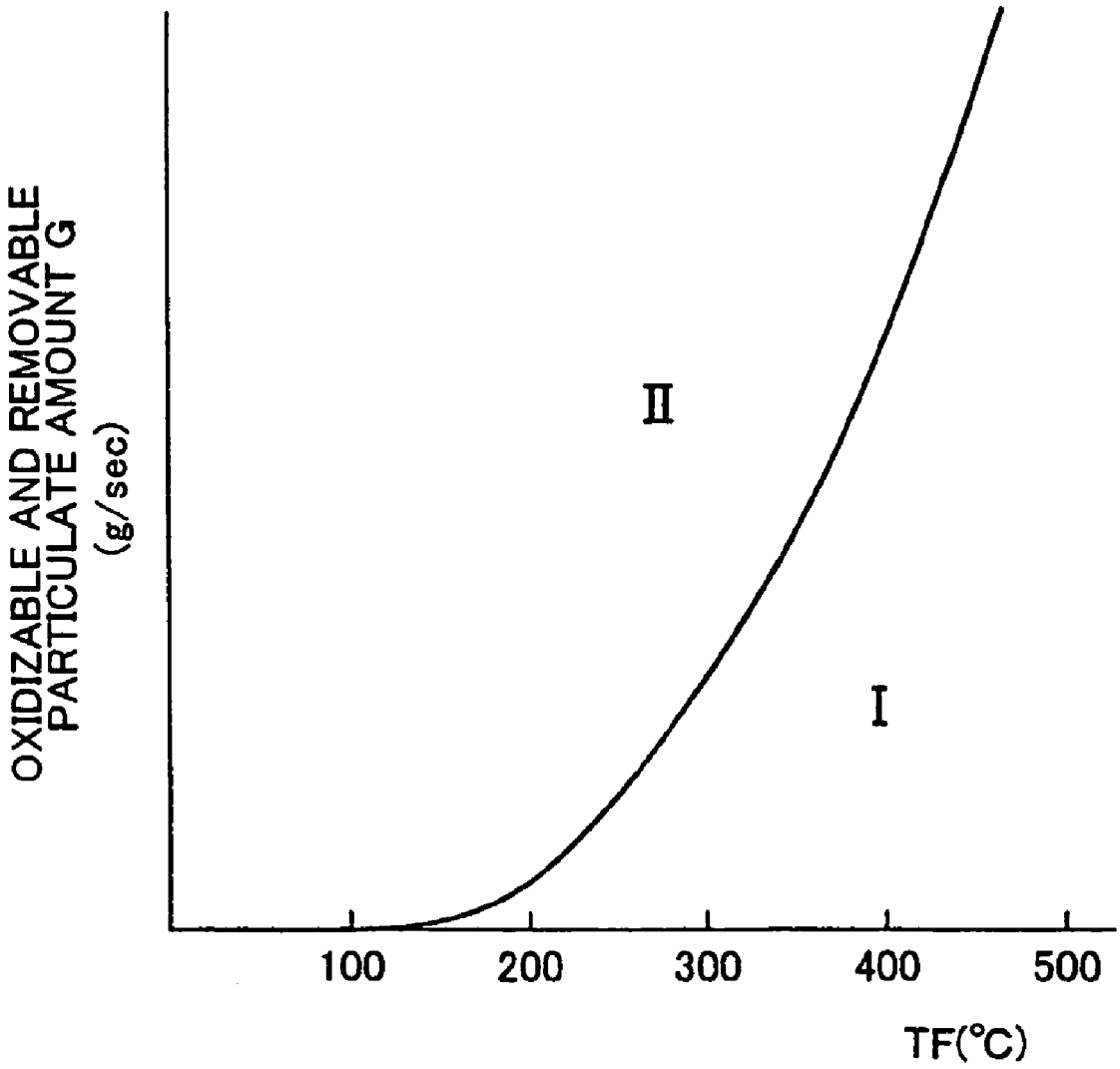
FIG. 9 is a diagram showing the relationship between the amount of particulates which can be oxidized and removed and the temperature of the particulate filter.

A solid line in FIG. 9 shows an amount G of the oxidizable and removable particulates which can be oxidized and removed per unit time without producing a bright flame. In FIG. 9, a horizontal axis indicates the temperature TF of the particulate filter 22. Defining the amount of particulates flowing into the particulate filter 22 per unit time as an influent particulate amount M, in the case where the influent particulate amount M is smaller than the oxidizable and removable particulate amount G, that is, the influent particulate amount M falls within the region I in FIG. 9, when all the particulates which have flowed into the particulate filter 22 come into contact with the particulate filter 22, they are oxidized and removed in a short time (from several seconds to several tens of minutes) on the particulate filter 22 without producing a bright flame.

Figure 8A:
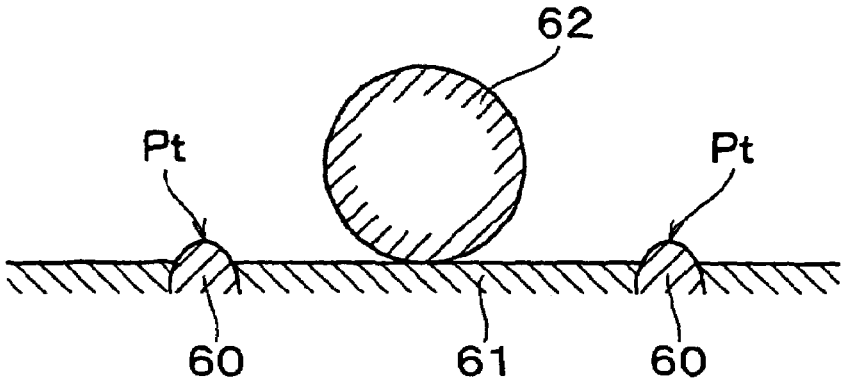
FIGS. 8A, 8B, and 8C are diagrams for illustrating the action of accumulating particulates.
Figure 8B:
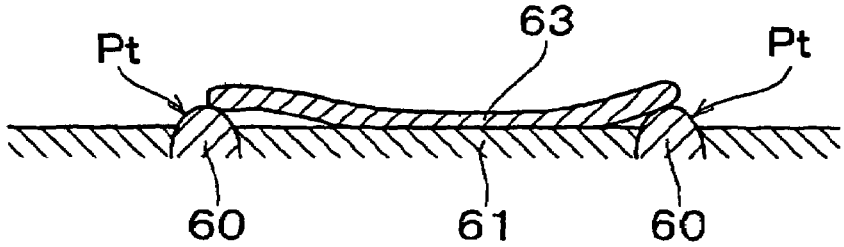
Figure 8C:
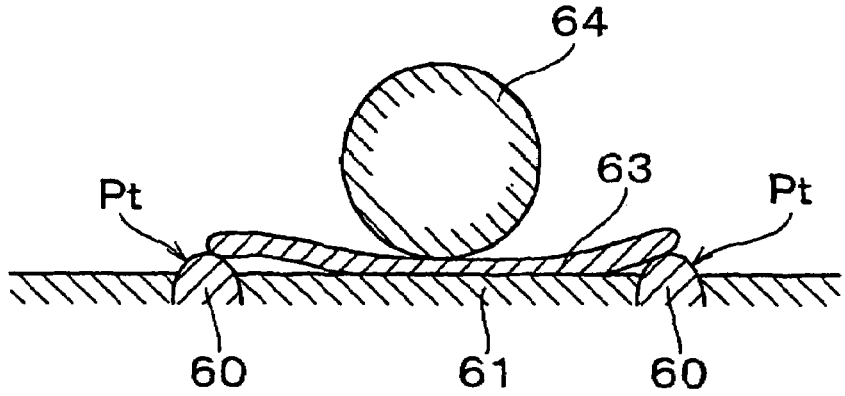

Contrarily to the above, in the case where the influent particulate amount M is larger than the oxidizable and removable particulate amount G, that is, the influent particulate amount M falls within the region II in FIG. 9, the amount of active oxygen is not enough for oxidizing all the particulates. The state of oxidization of the particulates in such a case is shown in FIGS. 8A, 8B, and 8C. In the case where the amount of active oxygen is not enough for oxidizing all the particulates, when the particulates 62 adhere to the active oxygen releasing agent 61 as shown in FIG. 8A, only some of the particulates 62 are oxidized, and the remaining particulates which have not sufficiently been oxidized remain on the carrier layer. If the state where the amount of active oxygen is insufficient continues, the particulates which have not been oxidized accumulate on the carrier layer one after another. As a result, the surface of the carrier layer is covered with the remaining particulates 63 as shown in FIG. 8B.

If the surface of the carrier layer is covered with the remaining particulates 63, the action of oxidizing nitric oxide NO and sulfur dioxide $SO_2$ by platinum Pt and the action of releasing active oxygen by the active oxygen releasing agent 61 are not carried out. Thus, the remaining particulates 63 remain as they are without being oxidized. Accordingly, another particulates 64 accumulate on the remaining particulates 63 one after another as shown in FIG. 8C. That is, the particulates come to accumulate into the multilayered state.

When the particulates accumulate into the multilayered state as described above, the particulates 64 are no longer oxidized by active oxygen O. Thus, still another particulates accumulate on the particulates 64 one after another. That is, if the state where the influent particulate amount M is larger than the oxidizable and removable particulate amount G continues, the particulates accumulate into the multilayered state on the particulate filter 22. Therefore, the accumulated particulates cannot be ignited and burned unless the temperature of the exhaust gas or the temperature of the particulate filter 22 is increased to high temperature.

As described above, the particulates are oxidized in a short time without producing a bright flame on the particulate filter 22 in the region I in FIG. 9, whereas the particulates accumulate into the multilayered state on the particulate filter 22 in the region II in FIG. 9. Therefore, in order to avoid the particulates from accumulating into the multilayered state on the particulate filter 22, the influent particulate amount M must constantly be smaller than the oxidizable and removable particulate amount G.

As is understood from FIG. 9, with the particulate filter 22 employed in this embodiment of the invention, the particulates can be oxidized even if the temperature TF of the particulate filter 22 is considerably low. Therefore, the influent particulate amount M and the temperature TF of the particulate filter 22 are kept in such a manner that the influent particulate amount M is constantly smaller than the oxidizable and removable particulate amount G.

If the influent particulate amount M is constantly smaller than the oxidizable and removable particulate amount G as described above, the particulates hardly accumulate on the particulate filter 22, and thus there is almost no increase in the back pressure.

On the other hand, once the particulates accumulate into the multilayered state on the particulate filter 22 as described above, it is difficult to oxidize the particulates by active oxygen O, even if the influent particulate amount M becomes smaller than the oxidizable and removable particulate amount G. However, if the influent particulate amount M becomes smaller than the oxidizable and removable particulate amount G in the state where the particulates which have not been oxidized start to remain, that is, in the state where the amount of the accumulated particulate is within a certain limitation, the remaining particulates are oxidized and removed by active oxygen O without producing a bright flame.

Meanwhile, thinking about a case where the particulate filter 22 is disposed and utilized in the exhaust passage of an internal combustion engine, the fuel or the lubricating oil contains calcium Ca, and therefore, the exhaust gas contains calcium Ca. This calcium Ca produces calcium sulfate $CaSO_4$ in the presence of sulfur trioxide $SO_3$. Thus-produced calcium sulfate $CaSO_4$ is in the form of group and is not thermally decomposed even at high temperature. Therefore, when calcium sulfate $CaSO_4$ is produced, the calcium sulfate $CaSO_4$ closes the micropores of the particulate filter 22. As a result, it is difficult for the exhaust gas to flow through the particulate filter 22.

In this case, when an alkaline metal or alkaline earth metal such as potassium K, which has a higher ionization tendency as compared with calcium Ca, is employed as the active oxygen releasing agent 61, the sulfur trioxide $SO_3$ dispersing into the active oxygen releasing agent 61 bonds with potassium K so as to form potassium sulfate $K_2SO_4$. Thus, the calcium Ca passes through the partitioning walls 54 of the particulate filter 22 without bonding with the sulfur trioxide $SO_3$ and flows into the exhaust gas outlet passages 51. Therefore, the micropores of the particulate filter 22 are not clogged. Consequently, as described above, it is preferable to employ, as the active oxygen releasing agent 61, an alkaline metal or alkaline earth metal having a higher ionization tendency as compared with calcium Ca, that is, potassium K, lithium Li, cesium Cs, rubidium Rb, barium Ba, and strontium Sr.

The invention is also applicable to the case where only a noble metal such as platinum Pt is supported on the carrier layers formed on both side surfaces of the particulate filter 22. However, in this case, the solid line of FIG. 9 indicating the oxidizable and removable particulate amount G slightly shifts toward a right side than the current solid line shown in FIG. 9. In this case, active oxygen is released from nitrogen dioxide $NO_2$ or sulfur trioxide $SO_3$ supported on the surface of platinum Pt.

In addition, it is also possible to employ, as the active oxygen releasing agent, a catalyst which can adsorb and hold nitrogen dioxide $NO_2$ or sulfur trioxide $SO_3$ and allows these adsorbed nitrogen dioxide $NO_2$ or sulfur trioxide $SO_3$ to release active oxygen.

The invention claimed is:

1. An exhaust purifying apparatus comprising a particulate filter for collecting particulates in an exhaust gas, the particulate filter including partitioning walls for forming a passage, the partitioning walls being made of a porous material, and end portions of adjacent partitioning walls being brought close to each other so as to narrow the respective passage formed by the partitioning walls so that the cross-sectional area of a flow path formed by the end portions of the adjacent partitioning walls is smaller than the cross-sectional area of a flow path formed by the remaining portions of the adjacent partitioning walls, wherein the particulate filter has extended portions that extend beyond both top ends of the partitioning walls from end surfaces of the particulate filter such that the extended portions prevent damage of the top ends of the partitioning walls when the particulate filter is being handled, wherein the end portions of the partitioning walls are combined together and the top ends of the partitioning walls are connected with each other so as to close one end surface of the passage, and wherein the extended portions are a portion of an outer peripheral wall of the particulate filter.

2. An exhaust purifying apparatus according to claim 1, characterized in that:

the extended portions are extended in an axial direction of the particulate filter.

3. An exhaust purifying apparatus according to claim 1, characterized in that:

the portions of the outer peripheral wall which extend beyond the top ends of the partitioning walls extend so as to surround the top ends of the partitioning walls.

4. An exhaust purifying apparatus according to claim 1, characterized in that:

the rigidity of the portions of the outer peripheral wall extending beyond the top ends of the partitioning walls is higher than the rigidity of the partitioning walls.

5. An exhaust purifying apparatus according to claim 4, characterized in that:

the thickness of the portions of the outer peripheral wall extending beyond the top ends of the partitioning walls is larger than the thickness of the partitioning walls.

6. An exhaust purifying apparatus according to claim 1, characterized in that:

a plurality of partitioning walls are comprised and the plurality of the partitioning walls form a plurality of passages, in some of the plurality of passages, downstream end portions of the partitioning walls are combined together and connected with each other so as to form a first connected portion, whereas in the remaining passages, upstream end portions of the partitioning walls are combined together and connected with each other so as to form a second connected portion.

7. An exhaust purifying apparatus according to claim 6, characterized in that:

at least one of the extended portions is provided with at least one of the plurality of the partitioning walls so as to extend toward the outside of the particulate filter in an axial direction into a length longer than the remaining partitioning walls.

8. An exhaust purifying apparatus according to claim 6, characterized in that:

at least one of the extended portions is provided with the partitioning walls which form at least one of the plurality of the first connected portions so as to extend toward the outside of the particulate filter in an axial direction into a length longer than the partitioning walls which form the remaining first connected portions.

9. An exhaust purifying apparatus according to claim 6, characterized in that:

at least one of the extended portions is provided with the partitioning walls which form at least one of the second connected portions among the plurality of the second connected portions so as to extend toward the outside of the particulate filter in an axial direction into a length longer than the partitioning walls which form the remaining second connected portions.

10. An exhaust purifying apparatus according to claim 1, characterized in that:

an oxidizing substance capable of oxidizing particulates is supported on the partitioning walls.

11. An exhaust purifying apparatus according to claim 1 wherein the top ends of the partitioning walls are sharply pointed.

12. An exhaust purifying apparatus comprising a particulate filter for collecting particulates in an exhaust gas, the particulate filter including partitioning walls for forming a passage, the partitioning walls being made of a porous material, and end portions of adjacent partitioning walls being brought close to each other so as to narrow the respective passage formed by the partitioning walls so that the cross-sectional areas of a flow path formed by the end portions of the adjacent partitioning walls is smaller than the cross-sectional area of a flow path formed by the remaining portions of the adjacent partitioning walls, characterized in that:

the particulate filter has extended portions that extend beyond both the downstream and upstream top ends of the partitioning walls from end surfaces of the particulate filter such that they prevent damage of the downstream and upstream top ends of the partitioning walls when the particulate filter is being handled, and the extended portions are a portion of the outer peripheral wall of the particulate filter.

13. An exhaust purifying apparatus according to claim 12, characterized in that:

the extended portions are extended in an axial direction of the particulate filter.

14. An exhaust purifying apparatus according to claim 12, characterized in that:

the portions of the outer peripheral wall which extend beyond the top ends of the partitioning walls extend so as to surround the top ends of the partitioning walls.

15. An exhaust purifying apparatus according to claim 12, characterized in that:

the rigidity of the portions of the outer peripheral wall extending beyond the top ends of the partitioning walls is higher than the rigidity of the partitioning walls.

16. An exhaust purifying apparatus according to claim 15, characterized in that:

the thickness of the portions of the outer peripheral wall extending beyond the top ends of the partitioning walls is larger than the thickness of the partitioning walls.

17. An exhaust purifying apparatus according to claim 12, characterized in that:

the end portions of the partitioning walls are combined together and the top ends of the partitioning walls are connected with each other so as to close one end surface of the passage.

18. An exhaust purifying apparatus according to claim 17, characterized in that:

a plurality of partitioning walls are comprised and the plurality of the partitioning walls form a plurality of passages, in some of the plurality of passages, downstream end portions of the partitioning walls are combined together and connected with each other so as to form a first connected portion, whereas in the remaining passages, upstream end portions of the partitioning walls are combined together and connected with each other so as to form a second connected portion.

19. An exhaust purifying apparatus according to claim 18, characterized in that:

at least one of the extended portions is provided with at least one of the plurality of the partitioning walls so as to extend toward the outside of the particulate filter in an axial direction into a length longer than the remaining partitioning walls.

20. An exhaust purifying apparatus according to claim 18, characterized in that:

at least one of the extended portions is provided with the partitioning walls which form at least one of the plurality of the first connected portions so as to extend toward the outside of the particulate filter in an axial direction into a length longer than the partitioning walls which form the remaining first connected portions.

21. An exhaust purifying apparatus according to claim 18, characterized in that:

at least one of the extended portions is provided with the partitioning walls which form at least one of the second connected portions among the plurality of the second connected portions so as to extend toward the outside of the particulate filter in an axial direction into a length longer than the partitioning walls which form the remaining second connected portions.

22. An exhaust purifying apparatus according to claim 12, characterized in that:

an oxidizing substance capable of oxidizing particulates is supported on the partitioning walls.

23. An exhaust purifying apparatus according to claim 12 wherein the top ends of the partitioning walls are sharply pointed.

* * * * *

UNITED STATES PATENT AND TRADEMARK OFFICE

CERTIFICATE OF CORRECTION

PATENT NO. : 7,141,088 B2
APPLICATION NO. : 10/485574
DATED : November 28, 2006
INVENTOR(S) : Koichiro Nakatani and Shinya Hirota It is certified that error appears in the above-identified patent and that said Letters Patent is hereby corrected as shown below:

Please amend the title page as follows:

Item (22) PCT Filed, please change "August 7, 2000" to --August 7, 2002--.

Signed and Sealed this

Twenty-eighth Day of August, 2007

JON W. DUDAS
*Director of the United States Patent and Trademark Office*